US005313755A

United States Patent [19]

Koenig, Jr.

[11] Patent Number: 5,313,755

[45] Date of Patent: May 24, 1994

[54] DRYWALL CORNER-FINISHING ACCESSORY

[75] Inventor: Joseph M. Koenig, Jr., Lincolnwood, Ill.

[73] Assignee: Trim-Tex, Inc., Lincolnwood, Ill.

[21] Appl. No.: 49,705

[22] Filed: Apr. 20, 1993

[51] Int. Cl.[5] ..... E04B 1/00

[52] U.S. Cl. ..... 52/255; 52/288; 52/417

[58] Field of Search ..... 52/287, 288, 254, 255, 52/256, 257, 417

[56] References Cited

U.S. PATENT DOCUMENTS

| | | | |
|---|---|---|---|
| 2,114,044 | 4/1938 | Bonnell | 52/288 MF |
| 2,593,859 | 4/1952 | Dunlap | 20/74 |
| 2,862,264 | 12/1958 | Perna | 20/74 |
| 3,444,657 | 5/1969 | Swanson | 52/288 |
| 4,288,016 | 9/1981 | Failla et al. | 227/30 |
| 4,313,991 | 2/1982 | Lamb | 428/131 |
| 4,722,153 | 2/1988 | Hardy | 52/255 |
| 4,763,455 | 8/1988 | Schneller | 52/417 X |
| 4,835,925 | 6/1989 | Hoffmann, Sr. | 52/288 |
| 4,977,718 | 12/1990 | Hoffman, Sr. | 52/288 |

FOREIGN PATENT DOCUMENTS

| | | |
|---|---|---|
| 644735 | 9/1962 | Italy . |
| 2166771A | 5/1986 | United Kingdom . |

*Primary Examiner*—Carl D. Friedman
*Assistant Examiner*—Creighton Smith
*Attorney, Agent, or Firm*—Dressler, Goldsmith, Shore & Milnamow, Ltd.

[57] ABSTRACT

A drywall corner-finishing accessory comprises three integrally joined, elongate strips, namely two relatively rigid, lateral strips and a relatively pliable, middle strip coextruded respectively from polyvinyl chloride having different durometer hardnesses. Each lateral strip has a rib along one edge. At its opposite edges, the middle strip is joined to the lateral strips at the distal edges of the ribs, preferably being joined to lateral surfaces of the ribs, so that a broad surface of the middle strip is stepped from the lateral strips. The accessory is flexible along the middle strip selectively to define a stepped, inside corner and to define a stepped, outside corner. The rib of each lateral strip guides a drywall-finishing tool and has a grooved pocket opening toward the distal edge of such lateral strip to receive drywall-finishing material.

8 Claims, 1 Drawing Sheet

Fig. 1
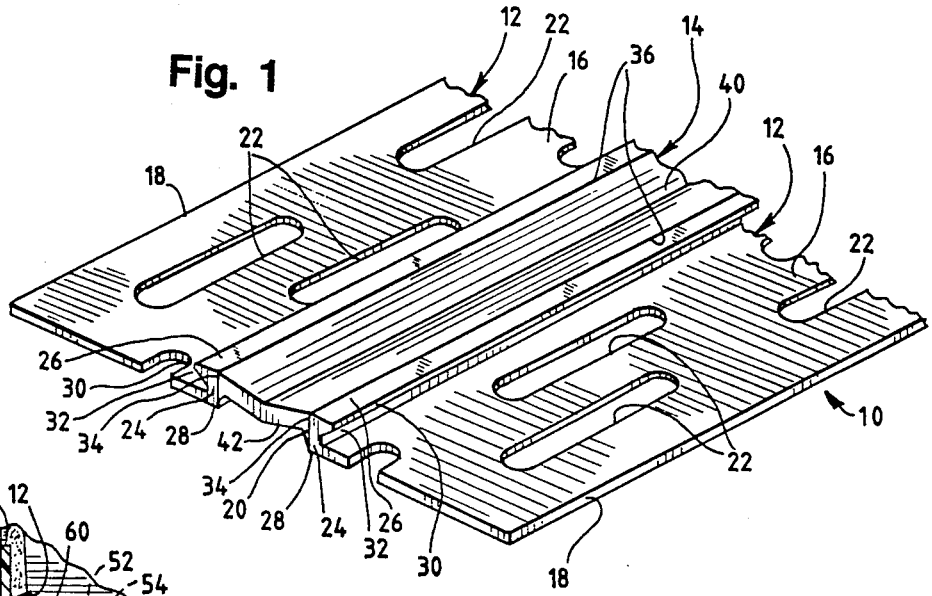
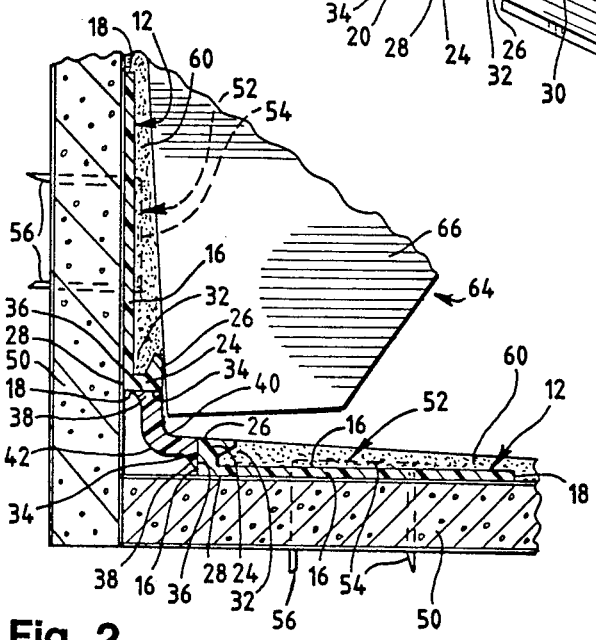
Fig. 2
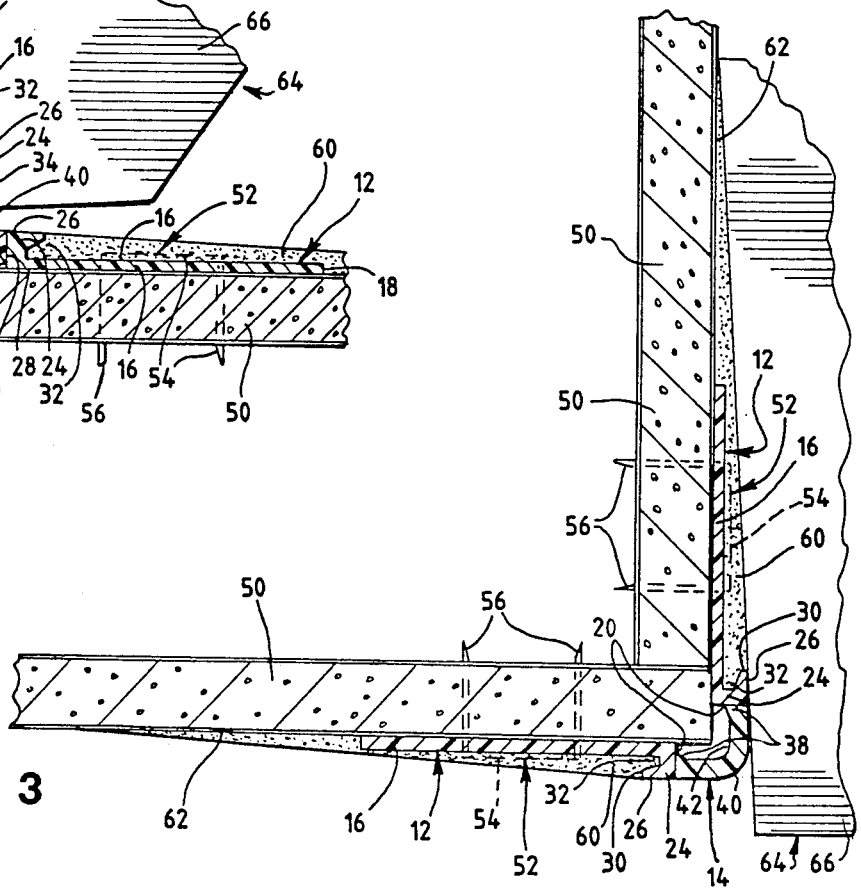
Fig. 3

DRYWALL CORNER-FINISHING ACCESSORY

TECHNICAL FIELD OF THE INVENTION

This invention pertains to a drywall corner-finishing accessory, which is flexible along a pliable, middle strip selectively to define a stepped, inside corner or a stepped, outside corner and which at least in some instances can serve as an expansion joint.

BACKGROUND OF THE INVENTION

Commonly, drywall corner beads, drywall seam-covering devices, and other drywall corner-finishing accessories are extruded from a substantially rigid, polymeric material, such as polyvinyl chloride. As exemplified in Failla et al. U.S. Pat. No. 4,288,016, such a corner bead has two strips joined by an integral, generally U-shaped lip, which functions to guide a drywall-finishing blade used to apply drywall-finishing material over the strips and adjoining drywall panels and which lends limited flexibility to such a corner bead.

However, as exemplified by Swanson U.S. Pat. No. 3,444,657, Lamb U.S. Pat. No. 4,313,991, and Hoffmann, Sr., U.S. Pat. No. 4,835,925, it is known for such accessories to be sufficiently flexible to be selectively useful at either inside or outside corners. As disclosed in the Swanson and Lamb patents, such accessories have grooves or notches to provide such flexibility. Along with embodiments of similarly grooved or notched accessories, the Hoffmann, Sr., patent discloses embodiments having strips of substantially rigid, polymeric material joined by hinges of substantially flexible, polymeric material.

Moreover, U.K. Patent Application GB 2,166,771A, as published May 14, 1986, discloses a corner molding of related interest. The corner moulding is flexible at three areas of reduced wall thickness.

This invention has resulted from efforts to improve such drywall corner-finishing accessories.

SUMMARY OF THE INVENTION

This invention provides a drywall corner-finishing accessory comprising three integrally joined, elongate strips, namely two lateral strips and a middle strip. Preferably, the lateral strips are relatively rigid and the middle strip is relatively pliable.

Each lateral strip has a broad portion with a distal edge and a proximal edge. Each lateral strip also has a rib with a distal edge and a proximal edge merging with the proximal edge of the broad portion of such lateral strip. The middle strip has two opposite edges and a generally uniform thickness substantially between the opposite edges. The middle strip is joined at each of the opposite edges to the rib of one of the lateral strips at the distal edge of the rib thereof so that a broad surface of the middle strip is stepped from the broad portions of the lateral strips.

The accessory is flexible along the middle strip, between its opposite edges, selectively to define a stepped, inside corner and a stepped, outside corner.

When the accessory is flexed to define a stepped, inside corner, the ribs are directed inwardly so as to constitute means for guiding a tool used to apply drywall-finishing material over the lateral strips. Moreover, the stepped surface of the middle strip faces inwardly and has a concave curvature substantially between the ribs of the lateral strips.

When the accessory is flexed to define a stepped, outside corner, the ribs are directed outwardly so as to constitute means for guiding a tool used to apply drywall-finishing material over the lateral strips. Moreover, the stepped surface of the middle strip faces outwardly and has a convex curvature substantially between the ribs of the lateral strips.

Preferably, the rib of each lateral strip has a grooved pocket to receive drywall-finishing material, the pocket opening toward the distal edge of such lateral strip. Preferably, the rib of each lateral strip has a lateral surface, to which the middle strip is joined. If the rib has a grooved pocket, as mentioned, the lateral surface having the middle strip joined thereto is opposite to the grooved pocket.

The lateral and middle strips may be advantageously coextruded from a relatively rigid, polymeric material for the lateral strips and from a relatively pliable, polymeric material for the middle strip. Preferably, the relatively rigid, polymeric material and the relatively pliable, polymeric material are polyvinyl chloride having different durometer hardnesses. Thus, when the accessory is flexed to define such an inside corner and when the accessory is flexed to define such an outside corner, the middle strip serves as an expansion joint.

These and other objects, features, and advantages of this invention are evident from the following description of a preferred embodiment of this invention with reference to the accompanying drawings.

BRIEF DESCRIPTION OF THE DRAWINGS

FIG. 1, on a larger than actual scale, is a fragmentary, perspective view of a drywall corner-finishing accessory according to this invention. As shown in FIG. 1, the accessory is unstressed.

FIG. 2 is a fragmentary, cross-sectional view taken through two drywall- panels meeting at a drywall corner, the drywall corner-finishing accessory stapled to the drywall panels and flexed so as to define an inside corner conforming to the drywall corner, and drywall-finishing material applied via a drywall-finishing tool, which is shown fragmentarily.

FIG. 3 is a fragmentary, cross-sectional view taken through two drywall panels meeting at a drywall corner, the drywall corner-finishing accessory stapled to the drywall panels and flexed so as to define an outside corner conforming to the drywall corner, and drywall-finishing material applied via a drywall-finishing tool, which is shown fragmentarily.

DETAILED DESCRIPTION OF PREFERRED EMBODIMENT

As shown in FIG. 1, a drywall corner-finishing accessory 10 constitutes a preferred embodiment of this invention. Basically, the accessory 10 comprises three integrally joined, elongate strips, namely two relatively rigid, lateral strips 12 and a relatively pliable, middle strip 14.

Preferably, the lateral strips 12 and the middle strip 14 are coextruded from a relatively rigid, polymeric material for the lateral strips 12 and a relatively pliable, polymeric material for the middle strip 14. Preferably, the relatively rigid, polymeric material and the relatively pliable, polymeric material are polyvinyl chloride having different durometer hardnesses.

Each lateral strip 12 has a broad portion 16 with a generally uniform thickness (e.g., about 0.04 inch) and with a distal edge 18, a proximal edge 20 and two rows of elongate slots 22. Holes may be used instead of slots. Each lateral strip 12 also has a rib 24 with a distal edge 26 and a proximal edge 28 merging with the proximal edge 20 of the broad portion 16 of such lateral strip 12. The rib 24 of each lateral strip 12 has a lateral surface 30 facing the distal edge 26 of such lateral strip 12 and a lateral surface 34 facing oppositely. The rib 24 of each lateral strip 12 has a grooved pocket 32 to receive drywall-finishing material, which pocket 32 opens at the lateral surface of the rib 24, toward the distal edge 26 of such lateral strip 12.

The middle strip 14 is wide (e.g., about 0.25 inch wide) and has two opposite edges 36 and a generally uniform thickness (e.g., about 0.05 inch) substantially between the opposite edges 36. As shown in FIG. 1, when the accessory 10 is unstressed, the middle strip 14 conforms to a shallow, inverted chevron in end profile, except that the middle strip 14 has gussets 38 at the opposite edges 36. The middle strip 14 is joined at each of the opposite edges 36 to the rib 24 of one of the lateral strips 12, specifically to the lateral surface 34 of the rib 24 thereof, so that one broad surface 40 of the middle strip 14 merges with the distal edges 26 of the ribs 22. The middle strip 14 has a broad surface 42 opposite to the broad surface 40 merging therewith. As shown in FIG. 1, when the accessory 10 is unstressed, each of the broad surfaces 40, 42, of the middle strip 14 conforms generally to a shallow V in end profile.

The distal edges 26 of the ribs 24 and the broad surface 40 of the middle strip 14 are stepped (e.g., by about 0.085 inch at such edges 26) from the broad portions 16 of the lateral strips 12. Therefore, the accessory 10 defines a stepped, inside corner or a stepped, outside corner when the accessory 10 is flexed.

As shown in FIG. 2, the accessory 10 is flexible so as to define a stepped, inside corner conforming to an inside corner defined by two drywall panels 50. As shown in FIG. 3, the accessory 10 is flexible so as to define a stepped, outside corner conforming to an outside corner defined by two drywall panels 50.

When the accessory 10 is flexed to define a stepped, inside corner, the ribs 24 are directed inwardly. Also, the stepped surface 42 of the middle strip 14 is stepped inwardly from the broad portions 16 of the lateral strips 12 and is curved substantially between the ribs 24.

When the accessory 10 is flexed to define a stepped, outside corner, the ribs 24 are directed outwardly. Also, the stepped surface 42 of the middle strip 14 is stepped outwardly from the broad portions 16 of the lateral strips 12 and is curved substantially between the ribs 24.

After being flexed to define a stepped, inside corner or to define a stepped, outside corner, the accessory 10 is stapled to the drywall panels 50, via staples 52 having their heads 54 bearing against the broad portions 16 of the lateral strips 12 and having their legs 56 passing through the drywall panels 50.

Next, drywall-finishing material 60 is applied over the broad portions 16 of the lateral strips 12, over adjacent areas 62 of the drywall panels 50, and into the grooved pockets 32, via a drywall-finishing tool 64 having a straight-edged blade 66, which is guided by the ribs 24 and by those areas 62 of the drywall panels 50. As applied over the broad portions 16 of the lateral strips 12, drywall-finishing material 60 penetrates the elongate slots 22 to reach the underlying areas of the drywall panels 50.

After the applied material 60 has cured, the cured material 60 and the stepped surface 42 of the middle strip 14 may be then covered with paint, wallpaper, or other wallcovering material. Being relatively pliable, the middle strip 14 serves as an expansion joint.

So as to promote adherence of drywall-finishing material to the broad portions 16 of the lateral strips 12, the lateral strips 12 may be pre-primed. If the lateral strips 12 are extruded from polyvinyl chloride, a vinyl alkyd primer is suitable.

Since the accessory 10 is flexible along the middle strip 14 to any arbitrary angle within a wide range, usage of the accessory 10 is not restricted to right-angled corners, either inside or outside.

Various modifications may be made in the preferred embodiment described above without departing from the scope and spirit of this invention.

I claim:

1. A drywall corner-finishing accessory comprising three integrally joined, elongate strips, namely two relatively rigid, lateral strips and a relatively pliable, middle strip, each lateral strip having a broad portion with a distal edge and a proximal edge and having a rib with a distal edge and a proximal edge merging with the proximal edge of the broad portion of such lateral strip, the middle strip having two opposite edges and a generally uniform thickness substantially between the opposite edges and being joined at each of the opposite edges to the rib of one of the lateral strips at the distal edge of the rib thereof, the accessory being flexible along the middle strip, between the opposite edges of the middle strip, selectively to define a stepped, inside corner, in which the ribs are directed inwardly so as to constitute means for guiding a tool used to apply drywall-finishing material over the lateral strips, in which the middle strip has a concave surface stepped inwardly from the broad portions of the lateral strips and curved substantially between the ribs of the lateral strips, and in which the relatively pliable, middle strip serves as an expansion joint, and to define a stepped, outside corner, in which the ribs are directed outwardly so as to constitute means for guiding a tool used to apply drywall-finishing material over the lateral strips, in which the middle strip has a convex surface stepped outwardly from the broad portions of the lateral strips and curved substantially between the ribs of the lateral strips, and in which the relatively pliable, middle strip serves as an expansion joint.

2. The drywall corner-finishing accessory of claim 1 wherein the rib of each lateral strip has a lateral surface, to which the middle strip is joined.

3. The drywall corner-finishing accessory of claim 1 wherein the rib of each lateral strip has a grooved pocket to receive drywall-finishing material, the pocket opening toward the distal edge of such lateral strip.

4. The drywall corner-finishing accessory of claim 3 wherein the rib of each lateral strip has a lateral surface, to which the middle strip is joined so that a broad surface of the middle strip merges with the distal edges of the ribs.

5. The drywall corner-finishing accessory of claim 1 wherein the lateral and middle strips are coextruded from a relatively rigid, polymeric material for the lateral strips and from a relatively pliable, polymeric material for the middle strip, which serves as an expansion joint when the accessory is flexed to define such an inside corner and when the accessory is flexed to define such an outside corner.

6. The drywall corner-finishing accessory of claim 5 wherein the relatively rigid, polymeric material and the relatively pliable, polymeric material are polyvinyl chloride having different durometer hardnesses.

7. A drywall corner-finishing accessory comprising three integrally joined, elongate strips, namely two lateral strips and a middle strip, each lateral strip having a broad portion with a distal edge and a proximal edge and having a rib with a distal edge, a proximal edge merging with the proximal edge of the broad portion of such lateral strip, and a grooved pocket opening toward the distal edge of such lateral strip, the middle strip having two opposite edges and a generally uniform thickness substantially between the opposite edges and being joined at each of the opposite edges to the rib of one of the lateral strips at the distal edge of the rib thereof, the accessory being flexible along the middle strip, between the opposite edges of the middle strip, selectively to define a stepped, inside corner, in which the ribs are directed inwardly so as to constitute means for guiding a tool used to apply drywall-finishing material over the lateral strips and into the grooved pockets and in which the middle strip has a concave surface stepped inwardly from the broad portions of the lateral strips and curved substantially between the ribs of the lateral strips, and to define an outside corner in which the ribs are directed outwardly so as to constitute means for guiding a tool used to apply drywall-finishing material over the lateral strips and into the grooved pockets and in which the middle strip is has a convex surface stepped outwardly from the broad portions of the lateral strips and curved substantially between the ribs of the lateral strips.

8. The drywall corner-finishing accessory of claim 7 wherein the lateral and middle strips are coextruded from a relatively rigid, polymeric material for the lateral strips and from a relatively pliable, polymeric material for the middle strip, which serves as an expansion joint when the accessory is flexed to define such an inside corner and when the accessory is flexed to define such an outside corner.

* * * * *